United States Patent [19]

McCanse

[11] 4,124,080

[45] Nov. 7, 1978

[54] TRACTOR MOUNTED SCRAPER BLADE

[75] Inventor: James E. McCanse, Oregon, Ill.

[73] Assignee: Hesston Corporation, Hesston, Kans.

[21] Appl. No.: 760,659

[22] Filed: Jan. 19, 1977

Related U.S. Application Data

[62] Division of Ser. No. 663,670, Mar. 4, 1976, Pat. No. 4,061,194.

[51] Int. Cl.[2] ..... E02F 3/76

[52] U.S. Cl. ..... 172/447; 172/667

[58] Field of Search ..... 172/447, 442, 580, 477, 172/742, 805, 261, 223, 439, 804, 796; 91/412; 37/DIG. 7, 103

[56] References Cited

U.S. PATENT DOCUMENTS

| | | | |
|---|---|---|---|
| 2,270,943 | 1/1942 | Fruendel | 91/412 |
| 2,904,910 | 9/1959 | Armington | 172/805 |
| 3,033,394 | 5/1962 | Kashergen | 37/103 |
| 3,515,221 | 6/1970 | Fowler | 172/447 |
| 3,598,186 | 8/1971 | Coontz | 172/666 |
| 3,858,663 | 1/1975 | Lurwig | 172/447 |
| 3,991,832 | 11/1976 | Cooper | 172/804 |

*Primary Examiner*—Richard J. Johnson

*Attorney, Agent, or Firm*—Schmidt, Johnson, Hovey & Williams

[57] ABSTRACT

A material handling assembly has a frame for attachment to the three point hitch of a tractor. A laterally swingable boom extends rearwardly from the frame and has an upright shaft at its rear end rotatable about an upright axis for suspending a reversible scraper blade whose angularity may be varied as the shaft is rotated. The blade is releasably attached to and tiltable relative to the shaft. All four functions of raising and lowering the frame, swinging the boom, varying the angularity of the blade and tilting the blade are hydraulically controlled. A special four bar linkage coupled with the shaft provides for wide blade angularity adjustment. A fluid bypass arrangement interconnects the swing and angularity functions to accommodate for excessive loads which may be encountered when the attitude of the blade is to be varied in accordance with desired grading operations.

15 Claims, 12 Drawing Figures

Fig. 3.
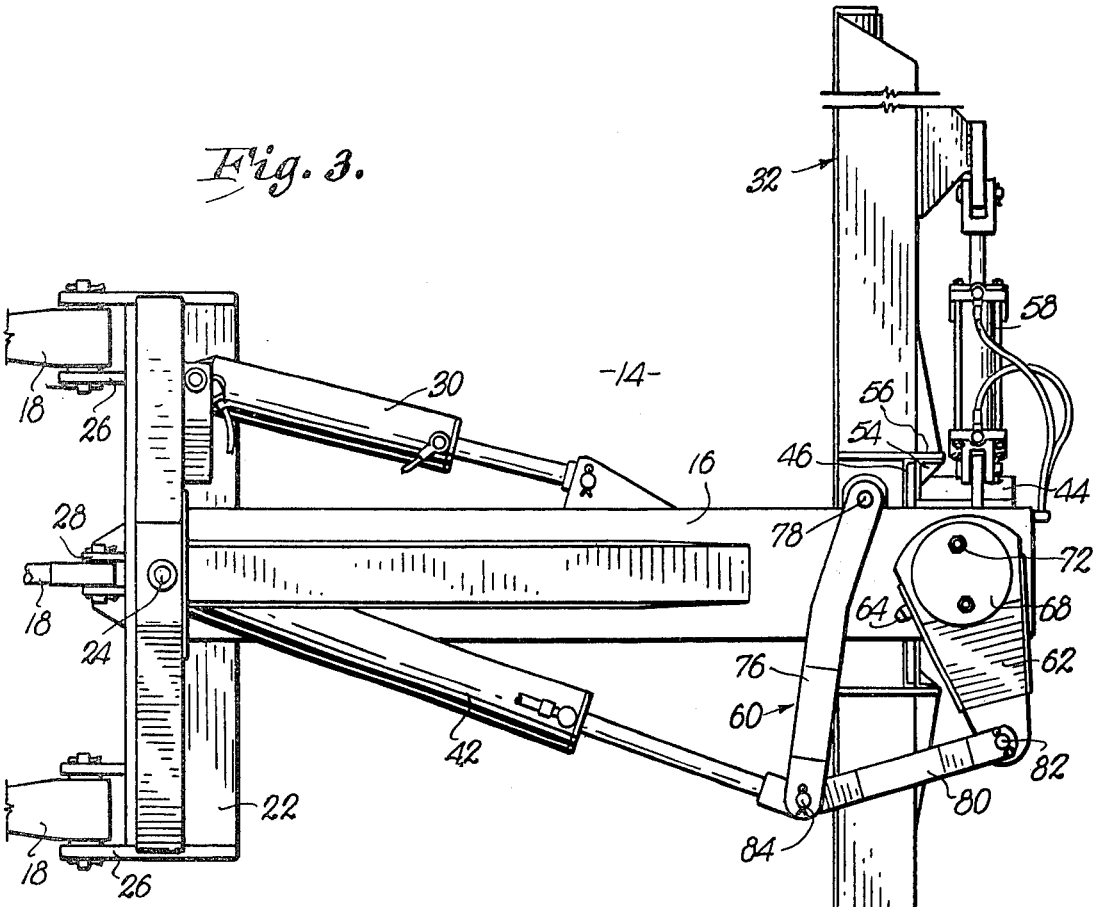
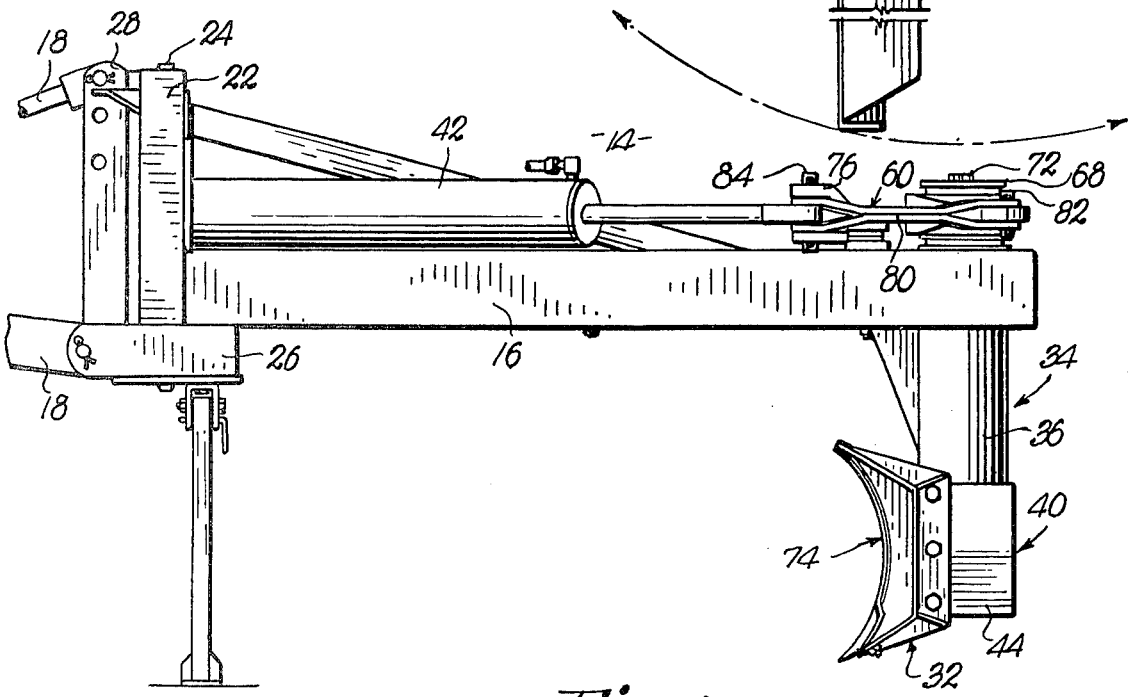
Fig. 4.

TRACTOR MOUNTED SCRAPER BLADE

This is a division of application Ser. No. 663,670, filed on Mar. 4, 1976, now U.S. Pat. No. 4,061,194.

An important object of the present invention is to provide a material handling assembly wherein a scraper blade may be raised and lowered, swung laterally, angularly adjusted and tilted, all from the operator's station on a tractor through manipulation of valves for controlling hydraulic circuits in order to permit virtually any and all types of grading operations which may be desired.

Another important object of the instant invention is the provision of an assembly of the aforementioned nature wherein is included an arrangement for permitting an unusually wide range of angularity adjustment of the blade relative to a swingable boom on which the blade is swingably supported.

Still another important object of my present invention is the provision of a system within the hydraulics for effectively bypassing the fluids between a pair of the cylinders when the loads which they encounter become excessive.

In the drawings:

FIG. 3 is a plan view thereof;

FIG. 4 is a side elevational view thereof;

Figure 1:
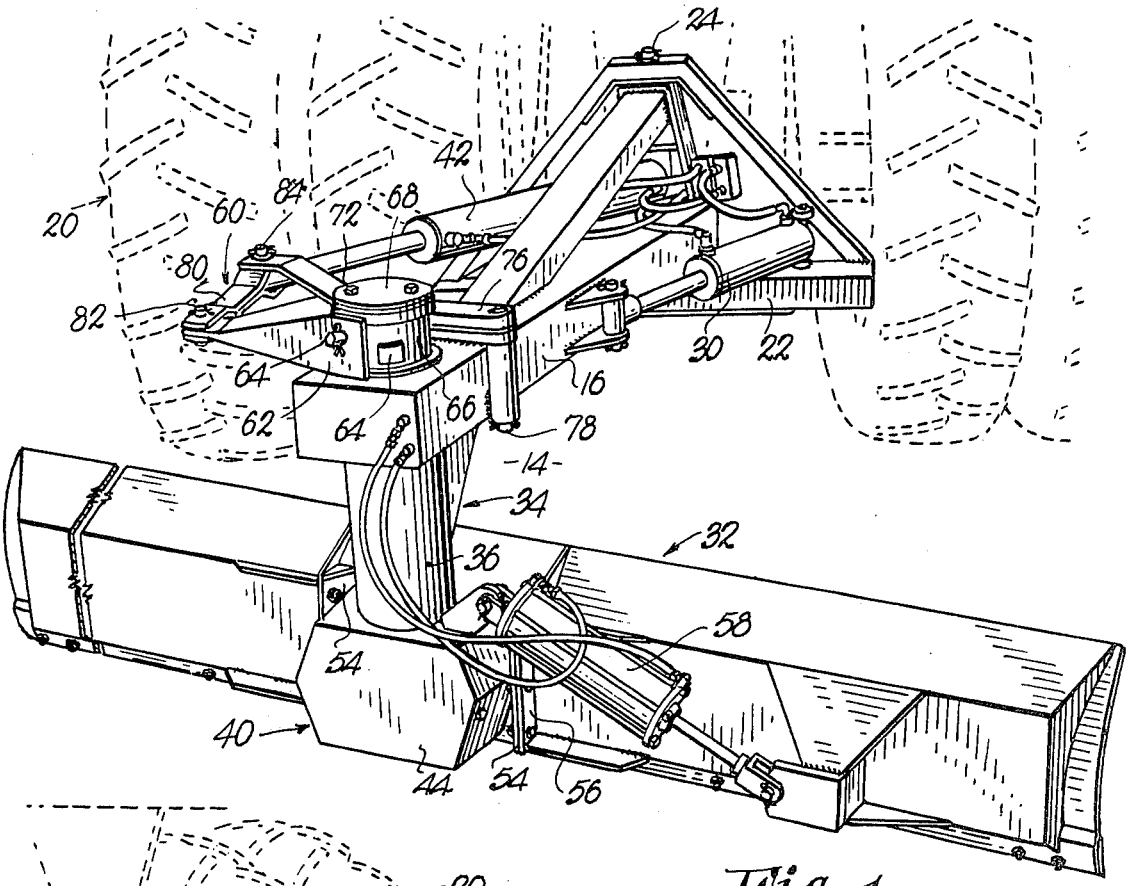
FIG. 1 is a rear perspective view of a tractor mounted scraper blade made pursuant to my present invention.
Figure 2:
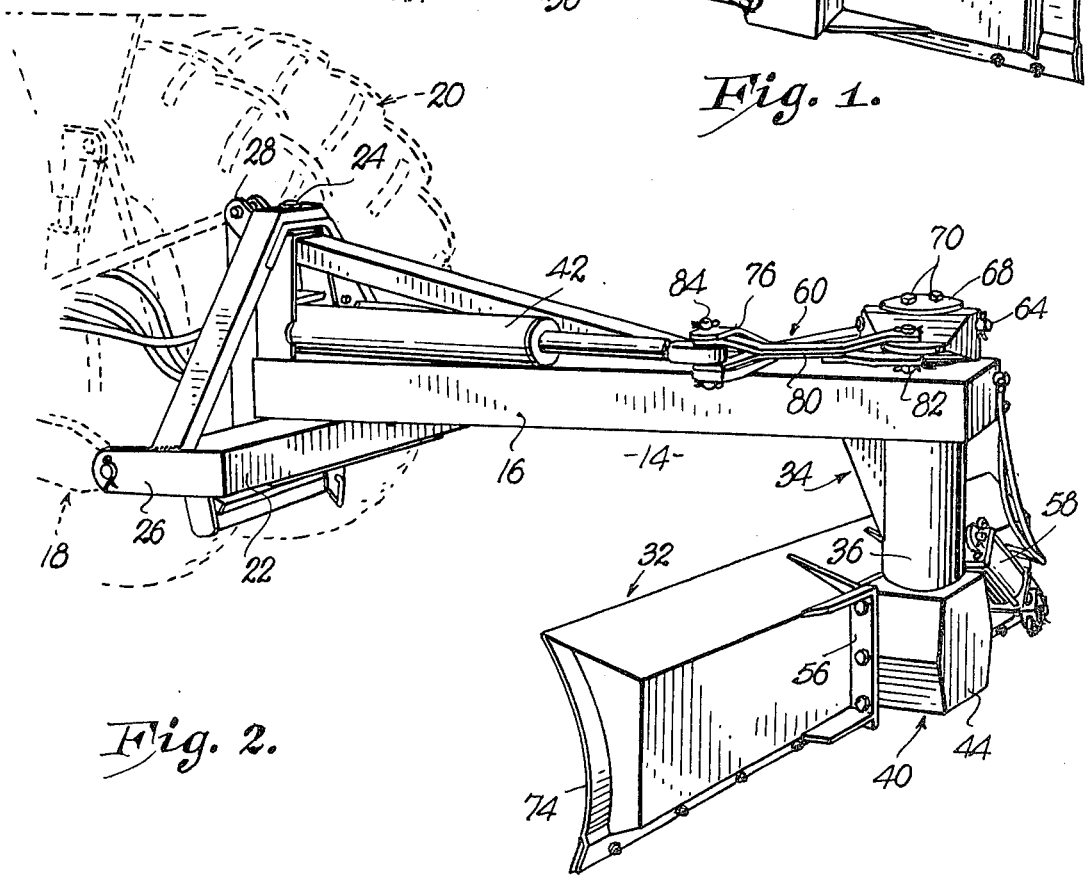
FIG. 2 is a perspective view showing the rear and one side thereof.

The material handling assembly 14 illustrated in the drawings includes an elongated boom 16 whose disposition essentially is normally horizontal as seen in FIG. 4, depending on the terrain. However, when the assembly 14 is attached to three-point hitch 18 of a tractor 20 (FIG. 1) the boom 16 may be swung up and down, it being understood that the hitch 18 is conventionally controlled for up and down swinging movement through use of the hydraulic power of the tractor 20.

Figure 8:
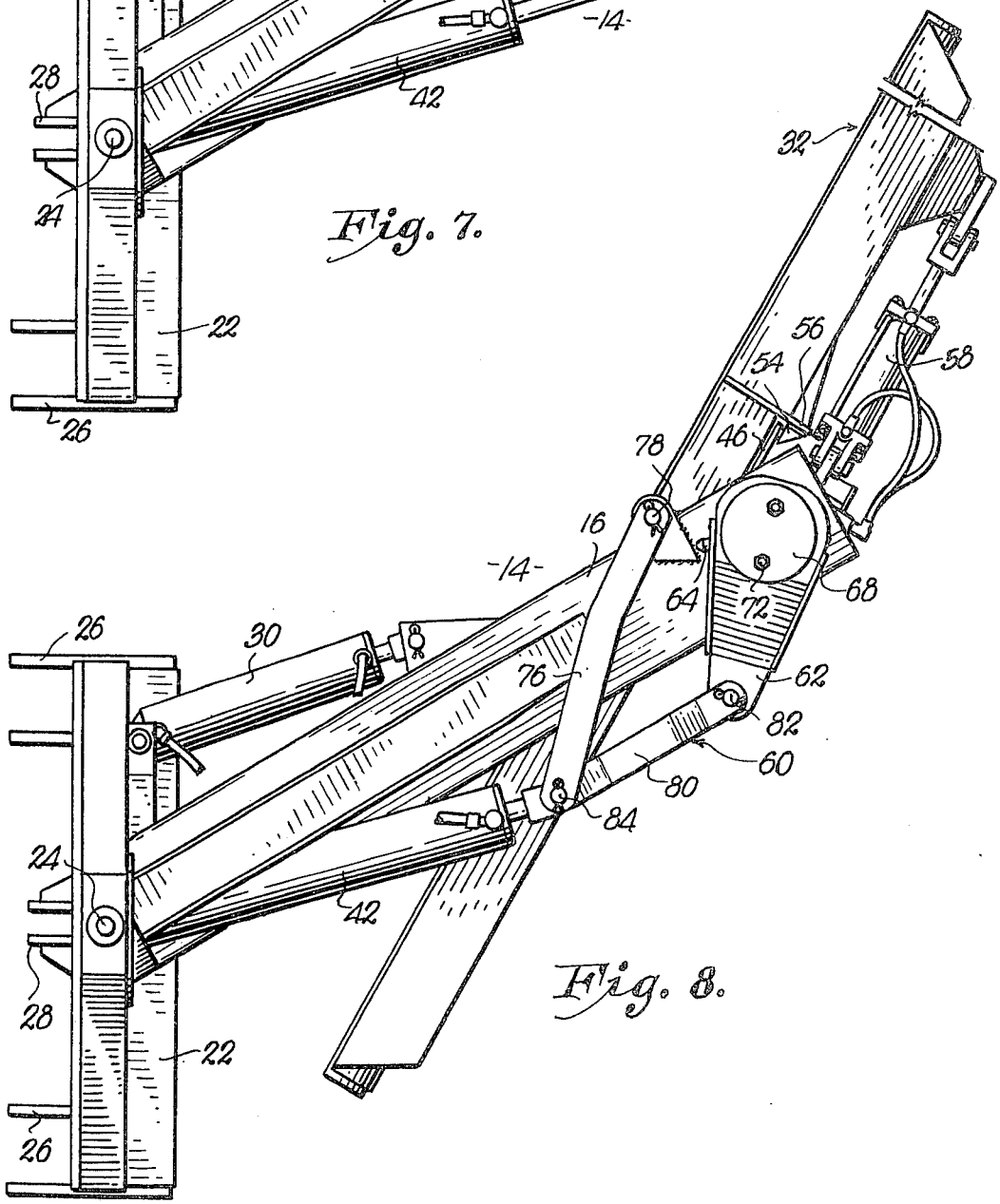
FIG. 8 is a plan view showing still another position of certain components.
Figures 9, 10, 11:
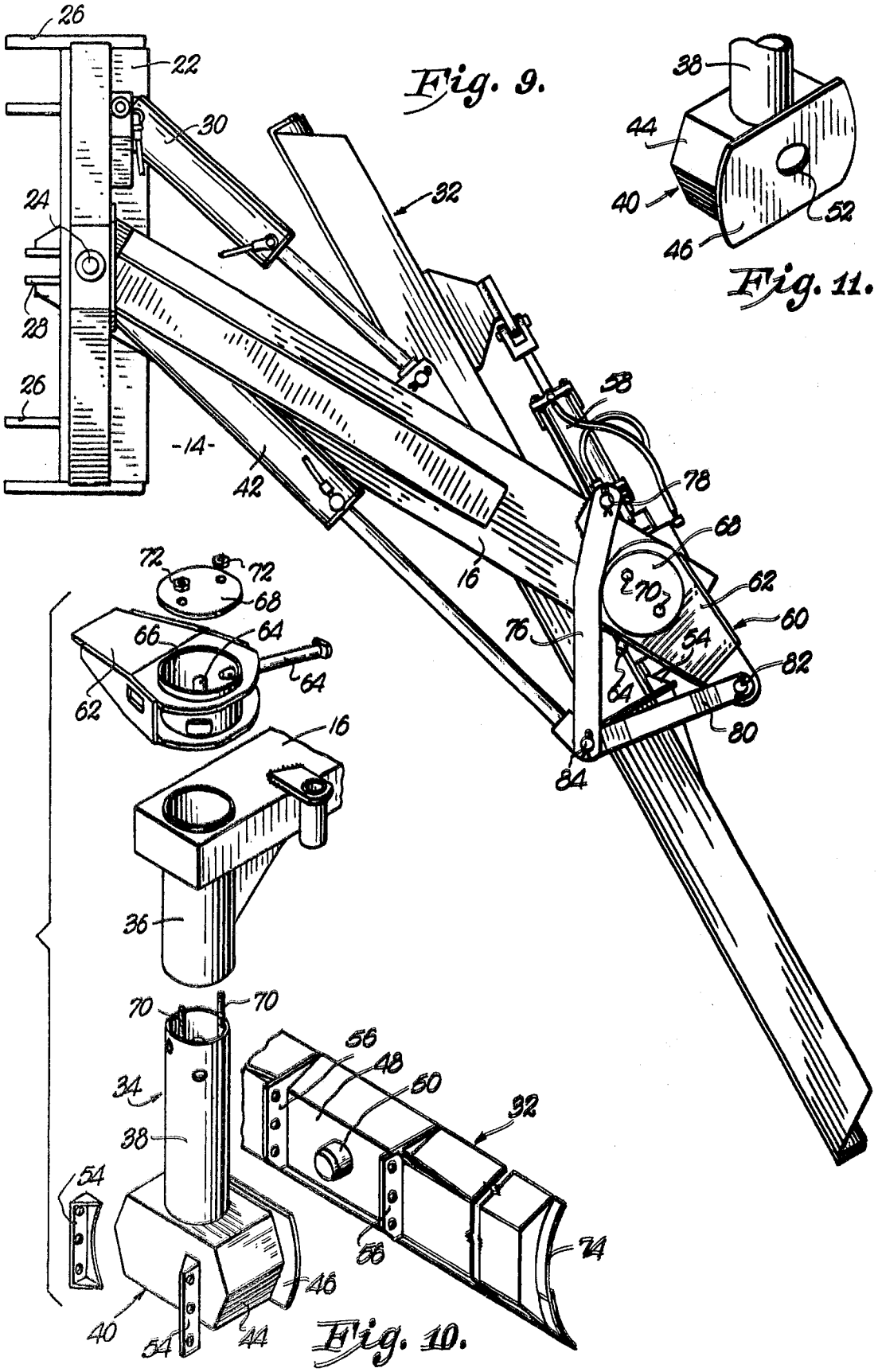
FIG. 9 is a plan view illustrating the components in still another position.
FIG. 10 is a fragmentary, exploded view of certain of the parts of the assembly.
FIG. 11 is a fragmentary perspective view of the blade supporting head.

While the boom 16 normally extends rearwardly from and in alignment with the path of travel of the tractor 20 as shown in FIG. 3, it is supported on a frame 22 by a pivot pin 24 at the forward end of the boom 16 for lateral swinging movement e.g. about 30° to the right (FIGS. 7 and 8) and about 30° to the left (FIG. 9). A pair of spaced lower lugs 26 and a central upper lug 28 extending forwardly of the frame 22 releasably and pivotally attach the frame 22 to the three links of the hitch 18 as is quite common.

A first adjusting means 30 in the nature of a fluid pressure piston and cylinder unit pivotally interconnects the frame 22 and the boom 16 for effecting the swinging movement of the boom 16 about the normally upright axis of the pin 24 in all raised and lowered positions of the assembly 14 as controlled by the selective positions of the hitch 18.

As depicted in FIG. 3, an elongated scraper blade 32 adjacent the rear end of the boom 16 is normally disposed at right angles to the boom 16 but is swingable relative thereto in all positions of the boom 16, up and down as well as to the right and to the left during operation of the unit 30. For example, the blade 32 may be swung relative to the boom 16 approximately 60° in one direction from the position shown in FIG. 3 to the positions shown in FIGS. 7 and 9 and approximately 60° in the opposite direction relative to the boom 16 from the position shown in FIG. 3 to the position shown in FIG. 8.

Figure 7:
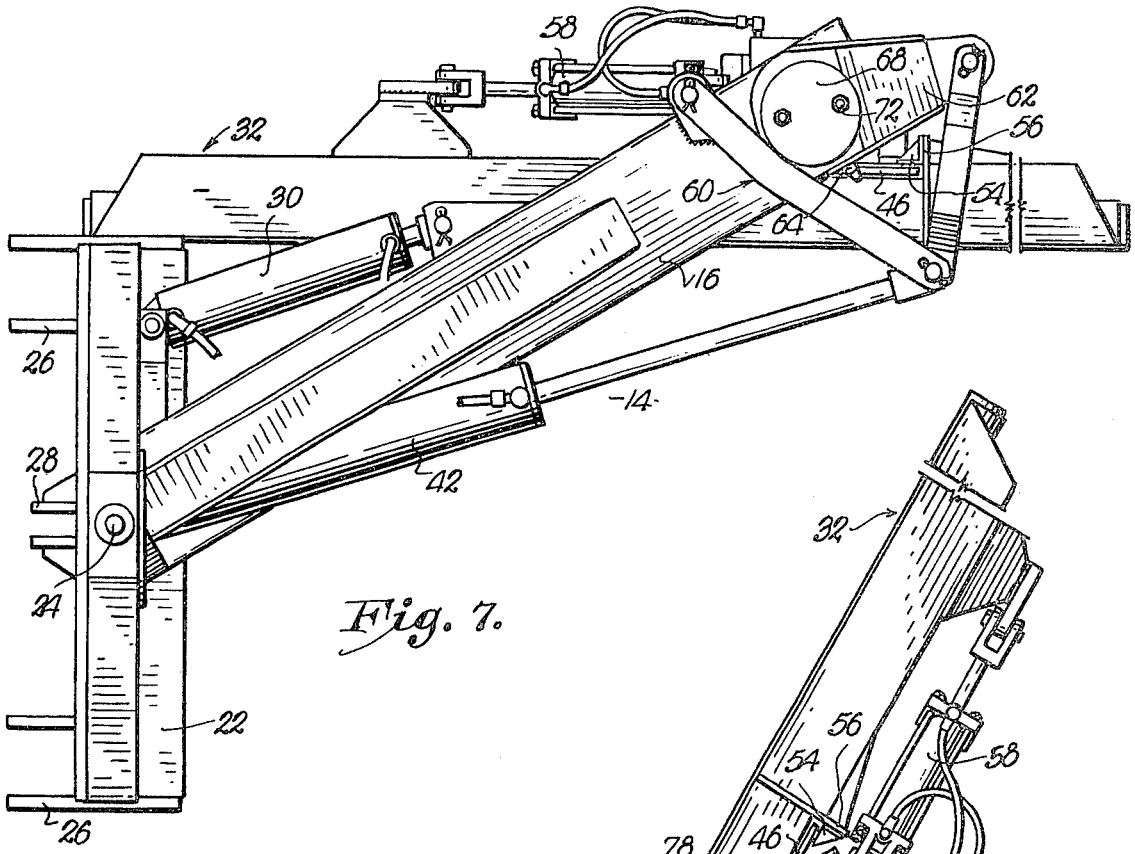
FIG. 7 is a plan view showing certain components in positions differing from the positions illustrated in FIG. 3.

Manifestly, the positions of the blade 32 relative to the boom 16 may be varied regardless of whether the boom 16 is disposed as shown in FIGS. 3, 7 and 8 or any other position relative to the frame 22 as selected through use of the unit 30. Hence, for example, when the boom 16 is swung to the position shown in FIGS. 7 and 8, the blade 32 may be swung to both ends of its path of swinging movement relative to the boom 16 as FIGS. 7 and 8 clearly illustrate. And, conversely, though not shown in the drawings, the blade 32 may be swung 120° (clockwise, viewing FIG. 9) while the boom 16 is positioned as shown in FIG. 9.

The blade 32 is swingably carried by the boom 16 through use of a suspension means 34 (FIG. 10) which includes a tube 36 extending through and rigid to the boom 16, an elongated shaft 38 rotatable within the tube 36 about the common axes of the tube 36 and the shaft 38, and a mount 40 at the lower end of the shaft 38 midway of the blade 32. A second adjusting means 42 (FIG. 9) in the nature of a fluid pressure piston and cylinder unit, pivotally connected to the pin 24 and operably coupled with the shaft 38 is provided for effecting the swinging movement of the blade 32 relative to the boom 16.

Figure 5:
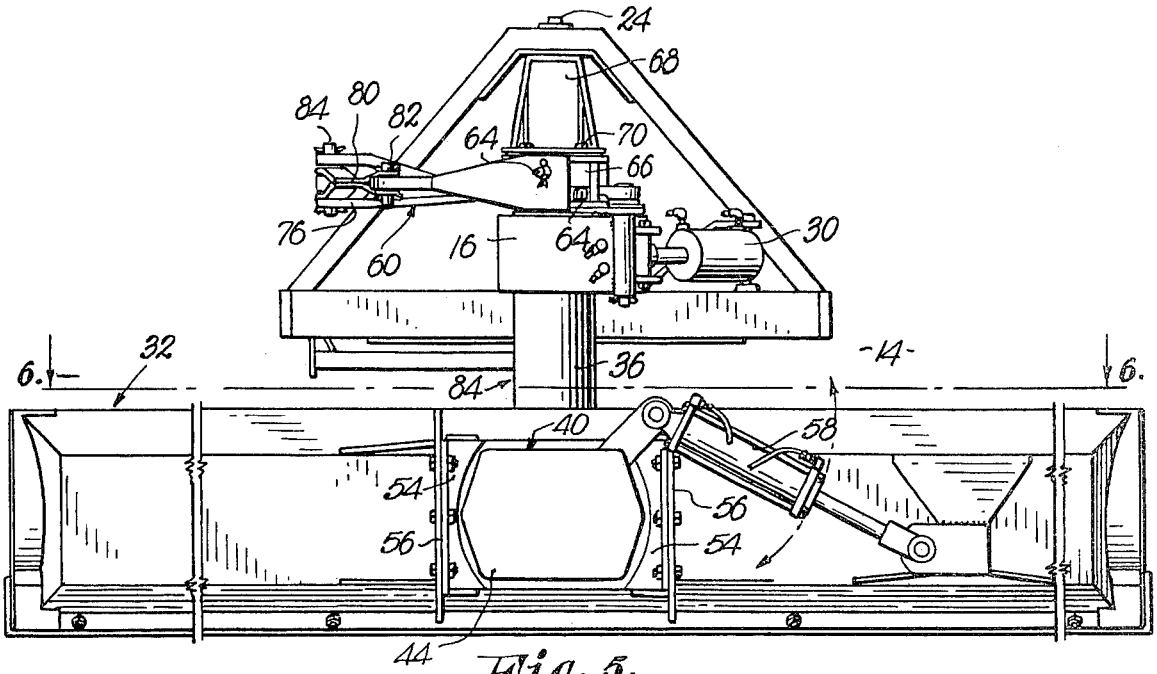
FIG. 5 is a rear elevational view thereof.
Figure 6:
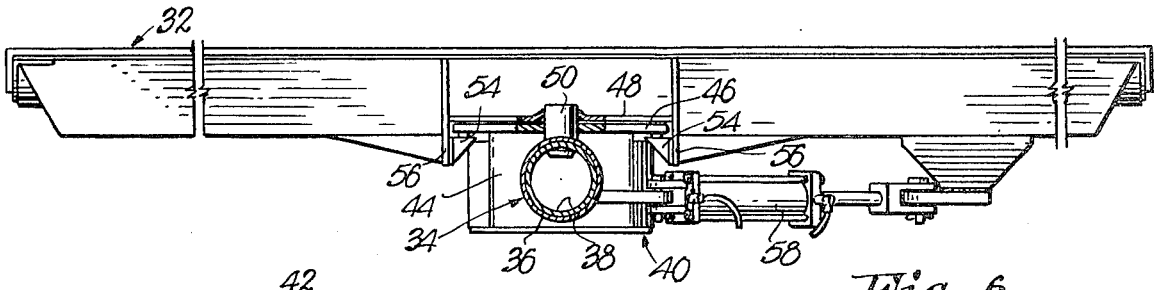
FIG. 6 is a cross sectional view taken on line 6—6 of FIG. 5.

The mount 40 includes a head 44 rigid to the lower end of the shaft 38 and provided with a front plate 46. A rear plate 48 on the blade 32 has a rearwardly-extending pintle 50 rotatable within a hole 52 (FIG. 11) in the plate 46. The plate 48 is held in sliding engagement with the plate 46 by a pair of brackets 54 bolted to flanges 56 rigid to the blade 32. The flanges 56 slide along the rear faces of the ends of the plate 46 during tilting movement of the blade 32 relative to the head 44 about the normally fore and aft axis of the hole 52. A third adjusting means 58 (FIG. 9) in the nature of a fluid pressure piston and cylinder unit, pivotally interconnecting the blade 32 and the head 44 (FIGS. 1, 5 and 6) effects a tilting movement of the blade 32 relative to the boom 16, preferably about 28° in both directions from the position shown in FIG. 5.

The operable coupling of the unit 42 with the shaft 38 includes a four bar linkage 60 (FIG. 9) wherein a first of such bars comprises the boom 16. A second of such bars comprises a crank 62 releasably attached to the upper end of the shaft 38 by a pair of crossing pins 64 extending radially through the member 38. The pins 64 also pass radially through a tubular hub 66 rigid to the crank 62 and surrounding the shaft 38 above the tube 36 and the boom 16. A cover plate 68 for the hub 66, the tube 36 and the shaft 38 is releasably attached to the latter by bolts 70 rigid to the shaft 38 and provided with nuts 72.

Thus, by removal of the pins 64, the blade 32 may be reversed such that its working surface 74 faces rearwardly instead of forwardly as shown in the drawings. After the shaft 38 has been so rotated 180° relative to the hub 66, the pins 64 are reinserted. This permits use of the blade 32 by reversal of the tractor 20 in areas not accessible when the surface 74 faces forwardly.

The linkage 60 has a third idler bar 76 (FIG. 9) swingably secured to the boom 16 by a pivot pin 78 and a fourth connecting bar 80 provided with a pin 82 pivotally attaching it to the crank 62, as well as a pin 84 pivotally attaching it to the bar 76, the pin 84 also pivotally receiving the unit 42.

This type of linkage 60 between the unit 42 and the shaft 38 is especially important and advantageous because it permits the large 120° angularity of the blade 32 relative to the boom 16 while still maintaining satisfactory leverage between the unit 42 and the blade 32. Such is not possible through use of conventional linkages.

Typically, ditches are dug from the center outwardly. Linkage 60 permits such operation, centering the load and allowing the operator to cut a ditch straddled by the tractor 20 as is evident from viewing FIG. 8. Although the boom 16 has been swung a full 30° to the right, nonetheless it is possible through the use of the linkage 60 to angle the blade 32 a full 60° relative to the boom 16 and position the left end of the blade 32 far enough forwardly to grade behind the right wheel of the tractor 20 from the center outwardly. No such operation would be possible if, after swinging the boom to the position shown in FIG. 8, the blade 32 could be angled only from 30° to 45°, for example, relative to the boom 16. Manifestly, the same advantages (not shown) result when grading behind the left wheel of the tractor 20.

Still further, as noted in FIG. 7, when the boom 16 is swung 30° to the right, full extension of the unit 42 (as distinguished from full retraction of the unit 42 in FIG. 8) places the blade 32 in alignment with the normal path of travel of the tractor 20. By backing off slightly it is now possible to drop the blade 32 into a narrow but flat bottom trench. Conventional grader blades can only cut V-shaped trenches having the disadvantage of filling rapidly and washing badly because the water flow is concentrated in a narrow notch instead of being spread out over a larger area. The ability of the assembly 14 to cut narrow, flat bottom trenches results from the use of the four bar linkage 60 above described.

Again, the same results are possible when the boom 16 is swung to the left, and it is to be recognized also that in all positions of the boom 16 relative to the frame 22, and in all positions of the blade 32 relative to the boom 16, unit 58 may be operated to preselect the desired tilt for the blade 32, and the hitch 18 actuated to preselect the desired height of the assembly 14.

Therefore, regardless of the position of the boom 16 as it is swung about the pivot pin 24, the linkage 60 will swing the blade 32 in opposite directions to and from a position placing its longitudinal axis perpendicular to the normal course of travel of the assembly 14. Moreover the linkage 60 will position such axis of the blade 32 parallel to the normal course of travel of the assembly 14 when the boom 16 is swung in opposite directions to either end of its path of swinging movement.

Figure 12:
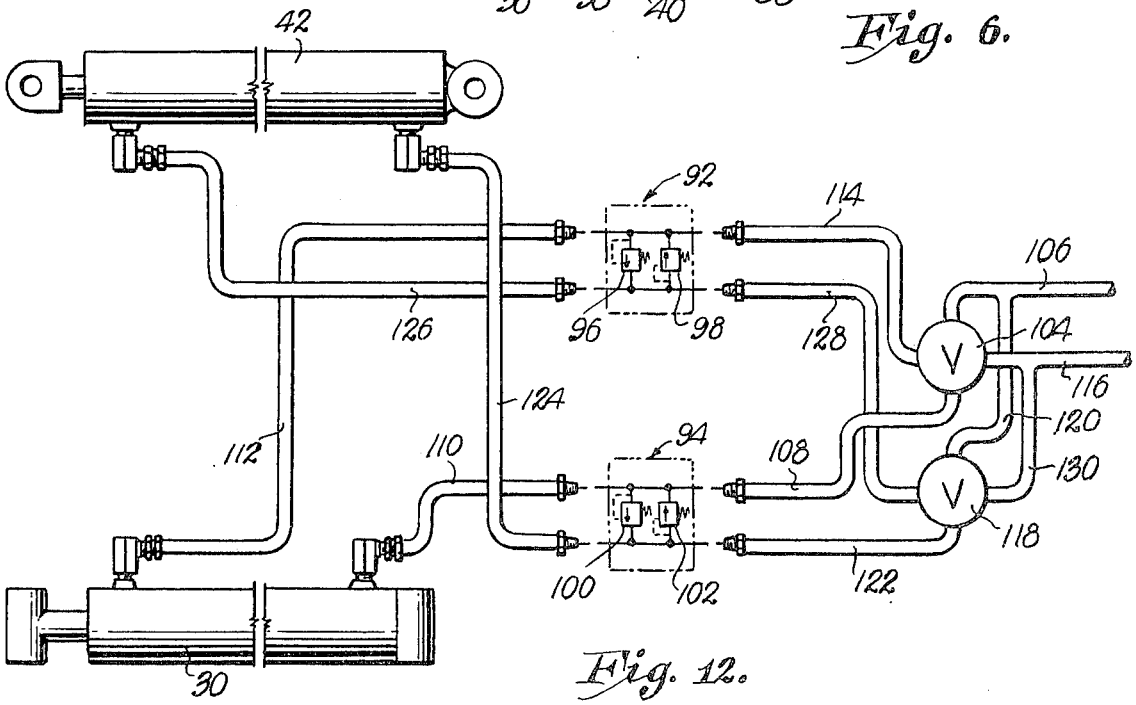
FIG. 12 is a schematic view illustrating certain of the hydraulic components and fluid flow system.

Another important feature of the instant invention is the relief valve setup illustrated by FIG. 12 of the drawings. It is necessary when using a bypass valve on a hydraulic cylinder to provide a place to which the oil may return. On a quick coupler type of hookup between the tractor 20 and the hydraulic power units of the assembly 14 there would be no place for the oil to return because manual control valves 104 and 118 on the tractor 20 would be closed and the hydraulic circuits blocked during normal operation.

It is possible, but not practical, to try to run a separate line from the bypass relief valve back to hydraulic fluid reservior on the tractor 20. Another alternative is to provide a balanced bypass volume. This is done by permitting the oil to bypass over the relief valve from the piston side of cylinder to its rod side. But the problem here is that there is more area on the piston side than on the rod side for each increment of piston-rod travel because of the displacement by the rod within that side of the cylinder occupied by the rod. This means that effort is being made to direct more oil into the rod side of the cylinder than there is space provided, thereby multiplying pressure and causing failure. Efforts to use such an alternative solution have, therefore, not been successful.

A third alternative is to center mount the cylinder piston by extending its rod entirely through the piston and thence out the opposite end of the cylinder. This approach, frequently used on tractor power steering units, is done purely to give balanced volume in the cylinder on both sides of the piston, but presents mounting problems and a cost sacrifice.

The novelty of the arrangement herein provided is the use of two separate units 30 and 42 having two separate functions, the boom swinging function of the unit 30 and the blade angling function of the unit 42, and the use of a pair of double relief valve components 92 and 94. The component 92 has a pair of relief valves 96 and 98 which discharge in opposite directions, and the component 94 has a pair of similar relief valves 100 and 102 which also discharge in opposite directions.

For purposes of explanation, it may be assumed the pump on the tractor 20 is capable of developing pressures of from 1850 to 2250 pounds per square inch, or an average of about 2000 pounds per square inch, and that a setting of about 1600 pounds per square inch on each of the valves will provide an adequate cushion for the uses intended for the assembly 14. Moreover, it should be noted that the cylinders of the units 30 and 42 have identical piston and rod areas.

Upon opening of the manual valve 104 on the tractor 20 in one direction, oil is pumped from the hydraulics of the tractor 20 to the piston side of the unit 30 via a high pressure line 106 from the tractor 20, through the valve 104, a line 108, the component 94 and a line 110. Oil is returned to the hydraulics of the tractor 20 from the rod side of the unit 30 via a line 112, through the component 92, a line 114, the valve 104 and a return line 116, returning oil to the tractor reservoir.

Upon opening of the valve 104 in the opposite direction, oil is pumped to the rod side of the unit 30 via the high pressure line 106, the valve 104, the line 114, the component 92 and the line 112. Oil is returned from the piston side of the unit 30 via the line 110, the component 94, the line 108, the valve 104 and the return line 116 to the reservoir.

When the manual valve 118 on the tractor 20 is opened in one direction, oil flows from the high pressure line 106, through a line 120, the valve 118, a line 122, the component 94 and a line 124 to the piston side of the unit 42. Oil returns from the rod side of the unit 42 via a line 126, the component 92, a line 128, the valve 118, a line 130 and the return line 116 to the reservoir.

When the valve 118 is opened in the opposite direction oil flows from the high pressure line 106 through the valve 118, the line 128, the component 92 and the line 126 to the rod side of the unit 42. Oil returns from the piston side of the unit 42 via the line 124, the component 94, the line 122, the valve 118 and the line 130 and 116 to the reservoir.

It is now to be noted that the relief 96 is from the rod side of the unit 30 to the rod side of the unit 42, and the relief 98 is from the rod side of the unit 42 to the rod side of the unit 30. On the other hand, the relief 100 is from the piston side of the unit 30 to the piston side of the unit 42, and the relief 102 is from the piston side of the unit 42 to the piston side of the unit 30.

Thus, when an extreme load is encountered by either of the units 30 or 42, oil is relieved to the other unit via component 92 or 94, causing the piston and rod of the unit receiving the oil to move in the opposite direction and discharge its oil back to the unit encountering the increased load.

For example, if an unusually heavy load tends to prevent retraction of the piston rod of the unit 30, the fluid emanating from the line 114 will flow through the relief valve 96 and the line 126 to the rod side of the unit 42 to retract the piston rod of the latter. Fluid flowing from the piston side of the unit 42 will pass via the line 124, the relief valve 102, the line 108, the valve 104 and the return line 116 to the reservoir.

On the other hand, if extension of the piston rod of the unit 30 were retarded, fluid emanating from the line 108 will bypass the line 110 and flow instead to the piston side of the unit 42 via the relief valve 100 and the line 124 causing extension of the piston rod of the unit 42. Fluid from the rod side of the unit 42 then flows via the line 126, the relief valve 98, the line 114, the valve 104 and the return line 116 to the reservoir.

Manifestly, comparable operations occur when the unit 42 meets unusual resistance to movement of its piston in either direction, by virtue of the bypassing afforded through use of the four relief valves of the components 92 and 94.

However, and more importantly, the relief valve components 92 and 94 function advantageously in the most common suitable situation of the blade 32 encountering an immovable object during movement of the tractor 20 while the valves 104 and 118 are in neutral. In that case the oil flows from one side of the affected unit 30 or 42 through a corresponding one of the relief valves 96, 98, 100 or 102, to the same side of the other unit 30 or 42, and the return oil flows from such other unit back to the affected unit.

For example, assume that the left end of the blade 32 were to strike an object which would tend to force the rod and piston of the unit 42 inwardly. Oil would then flow from the piston side of the unit 42 to the piston side of the unit 30 via the line 124, the valve 102 and the line 110. Oil would then flow from the rod side of the unit 30 to the rod side of the unit 42 via the line 112, the valve 96 and the line 126.

Conversely, if the forces on the blade 32 were opposite, such as to force the rod and piston of the unit 42 outwardly, oil would flow from the rod side of the unit 42 to the rod side of unit 30 via the line 126, the valve 98 and the line 112. And, oil would flow from the piston side of the unit 30 to the piston side of the unit 42 via the line 110, the valve 100 and the line 124.

Assume now that the blade 32 strikes an object affecting the unit 30. If its rod and piston move inwardly the fluid flow is from the unit 30 via the line 110, the valve 100 and the line 124 to the unit 42 as well as from the latter to the line 126, the valve 98, the line 112 and the unit 30. If the rod and piston of the unit 30 move in the opposite direction, oil flows to line 112, the valve 96, the line 126 and the unit 42, whereas oil flows from the unit 42 to the unit 30 via the line 124, the valve 102 and the line 110.

Accordingly, this arrangement provides a multiplying effect so that the pressure settings of each relief valve 96, 98, 100 and 102 is about one half that which would be needed if but a single relief valve were to be used.

While the function of the unit 30 to swing the boom 16 and the function of the unit 42 to angle the blade 32 have been thus so interconnected without connecting in, for example, the function of the unit 58 to tilt the blade 32, it is to be made clear that the above described valving is not limited in its application to such specific functions of boom swinging and blade angling.

Referring further to FIG. 12, it should be recognized that it is also possible to control the two functions of the units 30 and 42 by use of but one control valve at the tractor 20. For example, in that case, the valve 118 would be omitted and, of course, there would be no need for the lines 120, 122, 128 and 130. The connection between the line 122 and the component 94 as well as the connection between the line 128 and the component 92 would simply be plugged.

In such modification, the piston of the unit 42 would be retracted by actuation of the valve 104 for flow of oil from the pressure line 106 to the lines 114 and 112 so as to retract the piston of the unit 30. When such piston of the unit 30 becomes fully retracted, the fluid flows from the line 114, past the valve 96, through the line 126 and to the unit 42. Fluid flows from the unit 42, through the line 124, the valve 102, the line 108 and the valve 104 to the return line 116.

To extend the piston of the unit 42, the valve 104 would be actuated for fluid flow from the pressure line 106 to the lines 108 and 110 so as to fully extend the piston of the unit 30. Fluid then flows from the line 108 past the valve 100 to the line 124 and the unit 42. Fluid flows from the unit 42, through the line 126, the valve 98, the line 114 and the valve 104 to the return line 116.

Control of the unit 30 through use of the valve 104 remains the same as above explained with reference to FIG. 12. Moreover, the components 92 and 94 function the same as hereinabove set forth, insofar as bypassing fluid between the units 30 and 42 is concerned, in response to excessive loads on either or both of the units 30 and 42.

This use of but one valve 104 is not necessarily the preferred embodiment because, in some cases it may require compromising on the maximum pressure levels of the relief valves of the components 92 and 94. Also, it may not be entirely satisfactory in some applications to always require movement of the piston of the unit 30 to one or the other end of its stroke when it is desired to move the piston of the unit 42 but a small distance. Also, it is to be recognized that in this modification, after the piston of the unit 42 has been so adjusted, it then becomes necessary to readjust the piston of the unit 30 to the desired position, and such requirements when using but one valve 104 may also not be suitable in all of the many uses to which the system may be applied.

While extensible power units 30, 42, and 58 have been chosen for illustration of the concepts of my invention, manually adjustable units could, of course, be substituted. For example, a pair of extensible tubes, one telescoped into the other, might well be used. A series of holes through the tubes for receiving pins to secure the tubes in various positions would permit selection of the desired effective length of each pair of tubes. A ratchet type jack as a substitute, for example, for the unit 38, presents another type of manually extensible power unit which could well be quite satisfactory.

Having thus described the invention, what is claimed as new and desired to be secured by Letters Patent is:

1. In a material handling assembly:

a swingable boom;

a first unit for swinging the boom in opposite directions;

an elongated scraper blade having means pivotally supporting the same on the boom for swinging movement therewith and with respect thereto;

a second unit; and a coupling between the second unit and the blade for swinging the latter in opposite directions relative to the boom during actuation of the second unit, to and from a position placing its longitudinal axis in perpendicular relationship to the normal course of travel of said assembly in all positions of swinging movement of the boom, and for placing said axis substantially parallel to said course when the boom is swung toward either end of its path of swinging movement, said coupling including a four bar linkage, the boom comprising one bar of said linkage, said supporting means suspending the blade from the boom and including a shaft rotatable about a normally upright axis, a second bar of said linkage comprising a crank having means securing the same to the shaft, a third and a fourth bar of said linkage having means pivotally interconnecting the same, the third bar being swingably mounted on the boom, the fourth bar being pivotally connected with said crank.

2. The invention of claim 1, a mount attaching the blade to said supporting means for tilting movement of the blade about a normally fore and aft axis; and a third unit for effecting said tilting movement of the blade relative to the boom.

3. The invention of claim 1; a frame adapted for attachment to a mobile vehicle for support and up and down movement of the frame by said vehicle; and pivot means connecting the boom with said frame for said swinging movement of the boom.

4. The invention of claim 3; a mount attaching the blade to said supporting means for tilting movement of the blade about a normally fore and aft axis; and a third unit for effecting said tilting movement of the blade relative to the boom.

5. The invention of claim 1, said supporting means suspending the blade from the boom and including a shaft rotatable about a normally upright axis, said coupling being connected with the shaft at the upper end of the latter.

6. The invention of claim 5; a mount on the lower end of the shaft attaching the blade to said shaft for tilting movement of the blade about a normally fore and aft axis; and a third unit pivotally interconnecting the blade and the mount for effecting said tilting movement of the blade relative to the boom.

7. The invention of claim 6, said mount including a blade-supporting pintle, a pair of plates slidable relatively during tilting movement of the blade about an axis coincident with said pintle, and releasable means holding the plates in sliding interengagement.

8. The invention of claim 1, one end of said second unit being swingable about an axis common to the axis of swinging movement of the boom, the opposite end of said second unit being pivotally attached to said means pivotally interconnecting the third and fourth bars.

9. The invention of claim 1, said means securing the crank to the shaft being releasable for reversing said blade.

10. In a material handling assembly:

a swingable boom;

a first unit for swinging the boom in opposite directions;

an elongated scraper blade having means pivotally supporting the same on the boom for swinging movement therewith and with respect thereto;

a second unit; and a coupling between the second unit and the blade for swinging the latter in opposite directions relative to the boom during actuation of the second unit, to and from a position placing its longitudinal axis in perpendicular relationship to the normal course of travel of said assembly in all positions of swinging movement of the boom, and for placing said axis substantially parallel to said course when the boom is swung toward either end of its path of swinging movment, said coupling including a four bar linkage, the boom comprising one bar of said linkage.

11. The invention of claim 10, said supporting means suspending the blade from the boom and including a shaft rotatable about a normally upright axis, a second bar of said linkage comprising a crank having means securing the same to the shaft.

12. The invention of claim 9, said means suspending the blade from the boom including a tube extending through, depending from and rigid to the boom at one end of the latter, said shaft rotatable in the tube, said crank overlying the boom.

13. In a material handling assembly;

a swingable boom;

a first unit for swinging the boom in opposite directions;

an elongated scraper blade having means pivotally supporting the same on the boom for swinging movement therewith and with respect thereto;

a second unit; and a coupling between the second unit and the blade for swinging the latter in opposite directions relative to the boom during actuation of the second unit, to and from a position placing its longitudinal axis in perpendicular relationship to the normal course of travel of said assembly in all positions of swinging movement of the boom, and for placing said axis substantially parallel to said course when the boom is swung toward either end of its path of swinging movement, said coupling including a four bar linkage, the boom comprising one bar of said linkage, said supporting means suspending the blade from the boom and including a shaft rotatable about a normally upright axis, a second bar of said linkage comprising a crank having means securing the same to the shaft, said means securing the crank to the shaft being releasable for reversing said blade, said means suspending the blade from the boom including a tube extending through, depending from and rigid to the boom at one end of the latter, said shaft being rotatable in the tube, said crank overlying the boom, said crank having a hub surrounding the shaft, said releasable means including a pin traversing the hub and the shaft.

14. In a material handling assembly:

a swingable boom;

a first unit for swinging the boom in opposite directions;

an elongated scraper blade having means pivotally supporting the same on the boom for swinging movement therewith and with respect thereto;

a second unit; and a coupling between the second unit and the blade for swinging the latter in opposite directions relative to the boom during actuation of the second unit, said coupling including a swingable crank operably connected to the blade, a swingable member pivotally attached to the boom and link means pivotally connecting the crank with said member and said second unit.

15. In a material handling assembly:

an elongated, normally horizontal boom;

pivot means at one end of the boom supporting the latter for swinging movement about a first normally upright axis;

a first fluid piston and cylinder unit coupled with the boom for swinging the latter about said first axis;

a scraper blade beneath the boom;

a shaft having a lower end secured to the blade, said shaft depending from the boom and being mounted on the boom at the opposite end of the latter for rotation of the shaft about a second normally upright axis;

a crank rigidly secured to the shaft at the upper end of the latter and extending radially outwardly therefrom;

a second fluid pressure piston and cylinder unit swingably attached at one end thereof to said pivot means;

a swingable idler bar pivotally connected with the boom and extending laterally from the boom;

a swingable connecting bar pivotally coupled with said crank; and a pivot pin common to and interconnecting the idler bar, the connecting bar and the opposite end of said second unit, whereby the blade is swung relative to the boom about said second axis during operation of said second unit.

* * * * *